US005375716A

United States Patent [19]

Rubin et al.

[11] Patent Number: 5,375,716

[45] Date of Patent: Dec. 27, 1994

[54] BLOOD TUBE SAFETY BOX

[76] Inventors: David H. Rubin, 23 Lake Ave., New Rochelle, N.Y. 10801; Steven M. Gronsman, 1038 N. Hampton NW., Grand Rapids, Mich. 49505

[21] Appl. No.: 63,064

[22] Filed: May 20, 1993

Related U.S. Application Data

[63] Continuation-in-part of Ser. No. 943,573, Sep. 11, 1992, abandoned, which is a continuation of Ser. No. 701,813, May 17, 1991, Pat. No. 5,148,919.

[51] Int. Cl.[5] ..... B65D 85/20

[52] U.S. Cl. ..... 206/443; 206/563; 206/564; 220/506; 220/507; 211/71; 211/74

[58] Field of Search ..... 206/443, 483, 486, 562, 206/563, 570, 521, 829, 477, 564; 211/71, 74, 76; 220/507, 506

[56] References Cited

U.S. PATENT DOCUMENTS

| | | | |
|---|---|---|---|
| 1,739,801 | 12/1929 | Pitts . | |
| 1,987,373 | 1/1935 | Shapiro | 220/507 |
| 2,265,172 | 12/1941 | Katz | 220/506 |
| 2,292,626 | 8/1942 | Ferguson | 220/507 |
| 2,612,261 | 9/1952 | Percopo | 220/507 |
| 2,725,782 | 12/1955 | Worley . | |
| 3,175,695 | 3/1965 | Goodman et al. . | |
| 3,464,567 | 9/1969 | Gowdy et al. . | |
| 3,474,913 | 10/1969 | Jungner et al. . | |
| 3,643,812 | 2/1972 | Mander et al. . | |
| 3,918,920 | 11/1975 | Barber . | |
| 3,941,237 | 3/1976 | Mac Gregor, Jr. . | |
| 4,001,444 | 1/1977 | Clarke . | |
| 4,032,066 | 6/1977 | Wright | 211/74 |
| 4,040,234 | 8/1977 | Stockdale et al. . | |
| 4,068,798 | 1/1978 | Rohde . | |
| 4,124,122 | 11/1978 | Emmitt . | |
| 4,207,289 | 6/1980 | Weiss . | |
| 4,240,547 | 12/1980 | Taylor . | |
| 4,284,603 | 8/1981 | Korom . | |
| 4,411,868 | 10/1983 | Noack . | |
| 4,453,639 | 6/1984 | Sharma . | |
| 4,510,119 | 4/1985 | Hevey . | |
| 4,534,465 | 8/1985 | Rothermel et al. . | |
| 4,742,910 | 5/1988 | Staebler . | |
| 4,754,883 | 7/1988 | Grzywa . | |
| 4,787,523 | 11/1988 | Kalous . | |
| 4,826,003 | 5/1989 | Levy . | |
| 4,840,618 | 6/1989 | Marvel . | |
| 4,848,542 | 7/1989 | Burnette et al. . | |
| 4,925,630 | 5/1990 | Grunwald . | |
| 4,929,427 | 5/1990 | Guala . | |
| 4,982,850 | 1/1991 | Mears . | |
| 4,997,090 | 3/1991 | Lenmark, Sr. et al. . | |
| 5,047,019 | 9/1991 | Sincock . | |
| 5,069,336 | 12/1991 | Mauthe | 220/507 |
| 5,148,919 | 9/1992 | Rubin | 206/443 |

*Primary Examiner*—David T. Fidei
*Attorney, Agent, or Firm*—Baker & Botts

[57] ABSTRACT

According to the present invention, there is provided a durable, lightweight disposable container containing a plurality of holders for holding blood product tubes. These tubes are firmly secured in each slot yet can be easily removed from the slot after filling. According to a preferred embodiment, the box can be fixed to a table top or other substantially flat surface in an area where the blood drawing procedure is to occur.

23 Claims, 13 Drawing Sheets

BLOOD TUBE SAFETY BOX

This is a continuation-in-part of application Ser. No. 07/943,573 filed Sep. 11, 1992, now abandoned, which in turn is a continuation of application Serial No. 07/701,813 filed May 17, 1991, now U.S. Pat. No. 5,148,919.

FIELD OF THE INVENTION

The present invention relates to a blood tube safety box and more particularly, to an apparatus for simplifying and improving the safety of fluid transfer processes.

BACKGROUND OF THE INVENTION

The epidemic of acquired immunodeficiency syndrome (AIDS) has led health care workers to focus on the risk they face in the hospital and clinic environments. In the United States, nearly 150,000 cases of AIDS in adults and adolescents were reported through July 1990.

In addition to AIDS, hospital workers have reason to be concerned about other illnesses they may be exposed to in the workplace. The Hepatitis Branch of the Centers for Disease Control has estimated that hundreds of health care workers die each year from the direct or indirect consequences of occupationally acquired hepatitis B. Additionally, thousands more become infected with the virus. Other studies have documented the transmission of at least 20 different pathogens by "needlestick" injuries. Needlestick injuries can occur, for example, in the process of collecting and/or transferring bodily fluids.

Despite the presumed widespread knowledge of the potential dangers of needlesticks, the incidence of these injuries is increasing. Furthermore, although the number of incidents of transmission of the HIV virus after a needlestick is relatively low (currently estimated to be less than 4/1000 needlesticks, infections in health care workers have been attributed to needlestick exposures. Not only are the medical consequences of needlesticks worrisome, the psychological consequences of unnecessary needlesticks are ever present for health care workers and their spouses or sexual partners.

Needlestick injuries effect all hospital personnel and occur throughout hospitals. Virtually every type of hospital personnel has sustained a needlestick injury at one time or another. This includes nurses, doctors, technicians, and housekeeping personnel. In addition, virtually every ward and department has been the site of needlesticks. Of further concern is the fact that in one study only 54% of those personnel who were victims of needlesticks reported the incident. In a large majority of cases, accidental needlesticks occurred during blood drawing procedures. In view of the foregoing, it is readily apparent that the risk of needlestick injuries and the concomitant transfer of potentially life threatening pathogens is a constant threat to hospital and clinical personnel.

Attempts have been made to address this problem, especially in the area of transferring bodily fluids from a syringe to a test tube. One such device is disclosed in U.S. Pat. No. 4,840,618 issued to Marvel. The Medical Safety Device disclosed in Marvel comprises a round elongated handle sized for being held in the fisted grip of a person. This handle loosely receives a test tube. A shield is positioned on top of the handle and extends radially outwardly therefrom to an extent sufficient to substantially shield the fisted hand of the person gripping the handle. It is further disclosed that there is an opening in the side of the handle to permit the test tube to be contacted to facilitate its ejection from the cavity in the handle, and to permit the test tube to be held in place while a syringe needle is extracted from the test tube to prevent slippage of the tube from the handle. A small opening in the end of the handle prevents a vacuum from forming between the bottom of the test tube and the bottom of the test tube cavity in the handle.

While Marvel provides a certain degree of safety with the shield, additional drawbacks exist. The need to hold the test tube through the opening in the handle can lead to further problems. For example, in the event the user's hand slips, it is possible that a tube could be pulled out of the holder while attempting to extract a needle. This could lead to breakage of the tube and/or spillage of the fluid. Additionally, if too much pressure is asserted on the side of the wall by the user, it is possible that the tube will break causing cuts and a possible transfer of pathogens to the holder of the tube. Also, if any blood is on the outside of the tube undesirable contact can occur. Moreover, this structure necessitates that the user's hand (other than the hand holding the needle) be in the vicinity of the needle which is dangerous even with the shield present. This is obviously undesirable.

Additionally, this structure only enables a single tube to be held. In certain instances, it is necessary or desirable to transfer fluids into or from a plurality of tubes.

A structure similar to Marvel is also disclosed in U.S. Pat. No. 4,742,910 issued to Staebler.

In U.S. Pat. 4,982,850 issued to Mears there is shown another hand held test tube holder structure. This device includes a base 12 which is designed to allow the test tube holder to stand independently on "balancing pads 26, 28 and 30. These balancing pads are undesirable since they permit a holder to slide along a surface or allow the holder to be easily knocked over. These are considered undesired movements. Each of the shafts 14–22 which hold the tubes, has a corresponding frontal slot 32–40, respectively. It is specifically disclosed that the shafts have a series of holes 42–50 aligned therewith to enable the test tubes or vials to be loosely inserted into the holder. This is undesirable since a tube can easily slide out of the holder.

It is disclosed that, in use, the user typically receives one or more vials that are already filled with blood samples that may be infected with the AIDS virus, and inserts the vials into the vertical shafts. There, they are stored until the user desires to transfer a fluid sample. After choosing the vial from which or to which a sample is to be transferred, the user places him thumb through the corresponding slot and presses the vial against the back of the corresponding shaft. A sample is removed from that vial by tilting the holder and needle toward one another and inserting the needle into the vial's top. This test tube holder is similar to Marvel in that it provides a safety shield at the top, it is hand held and the user contacts the tubes through a hole in the shaft to hold them in place. In at least one respect it differs from Marvel since it is designed for holding a plurality of tubes.

Therefore, this invention also suffers from many of the drawbacks of Marvel's device since the user must contact the vial to hold it in place while a needle is being withdrawn and further, because it requires a user's hand to contact the tubes and be near the needle, it must be tilted towards the needle and the tubes fit loosely into the vertical shafts.

Of course, various types of test tube racks and holders in general are known in the prior art, but to the knowledge of the applicant, none have been designed in order to facilitate and improve the safety of fluid transfer or address the other objects of the present invention.

SUMMARY OF THE INVENTION

It is, therefore, an object of the present invention to overcome these and other drawbacks of the prior art.

It is a further object of the present invention to avoid the need to contact a fluid container or a housing for a fluid container during a fluid transfer process.

It is a further object of the present invention to improve the safety and efficiency of fluid transfer processes.

It is a further object to enable efficient transport of a plurality of tubes after a fluid transfer process without having to contact the tubes.

These and other objects of the present invention are achieved by using a blood tube safety box which reduces the risk of needlesticks during high risk procedures involving fluid transfers. For simplicity, the present invention will be described in connection with blood transfer to and from test tubes. However, it is to be understood that the invention is not so limited.

According to one embodiment of the present invention, there is provided a durable, lightweight disposable container containing a plurality of holders for holding blood product tubes. These tubes are firmly secured in each slot yet can be easily removed from the slot after filling. According to a preferred embodiment, the box can be placed on a table top or other substantially flat surface in an area where the blood drawing procedure is to occur. Preferably, the box is secured to the table by suction cups or other fixation means. Once blood is drawn from a patient, for example, it can be transferred directly to the tubes secured in the box which is firmly affixed to the table. No physical contact with the tubes is necessary. The vacuum present in each tube automatically draws the blood into the tube until the desired amount of fluid fills the tube. After inserting fluid into one tube, the needle (e.g., syringe) can be withdrawn and placed in the next tube without contacting the tube or box and without fear of the tube being lifted out of the holder, and without contact by the person performing the job.

According to another preferred embodiment of the present invention, the blood tube safety box comprises a generally circular housing. Preferably, the circular housing has a plurality of slots of at least two different diameters to accommodate tubes of different sizes, for example, adult and pediatric size tubes.

The blood tube safety box according to the present invention can be inexpensively made and constructed of a plastic material (e.g., polypropylene). This enables it to be economically disposable. However, other materials could be used according to desired characteristics and performance.

While the invention is not so limited, each patient could be assigned his or her own box after the decision to obtain blood products has been made. After completion of (or before) blood drawing, the box with the patient's name and with the tubes firmly located therein can be transported to a lab or other facility for analysis without having to contact the tubes.

DETAILED DESCRIPTION OF THE PREFERRED EMBODIMENTS

Figure 1:
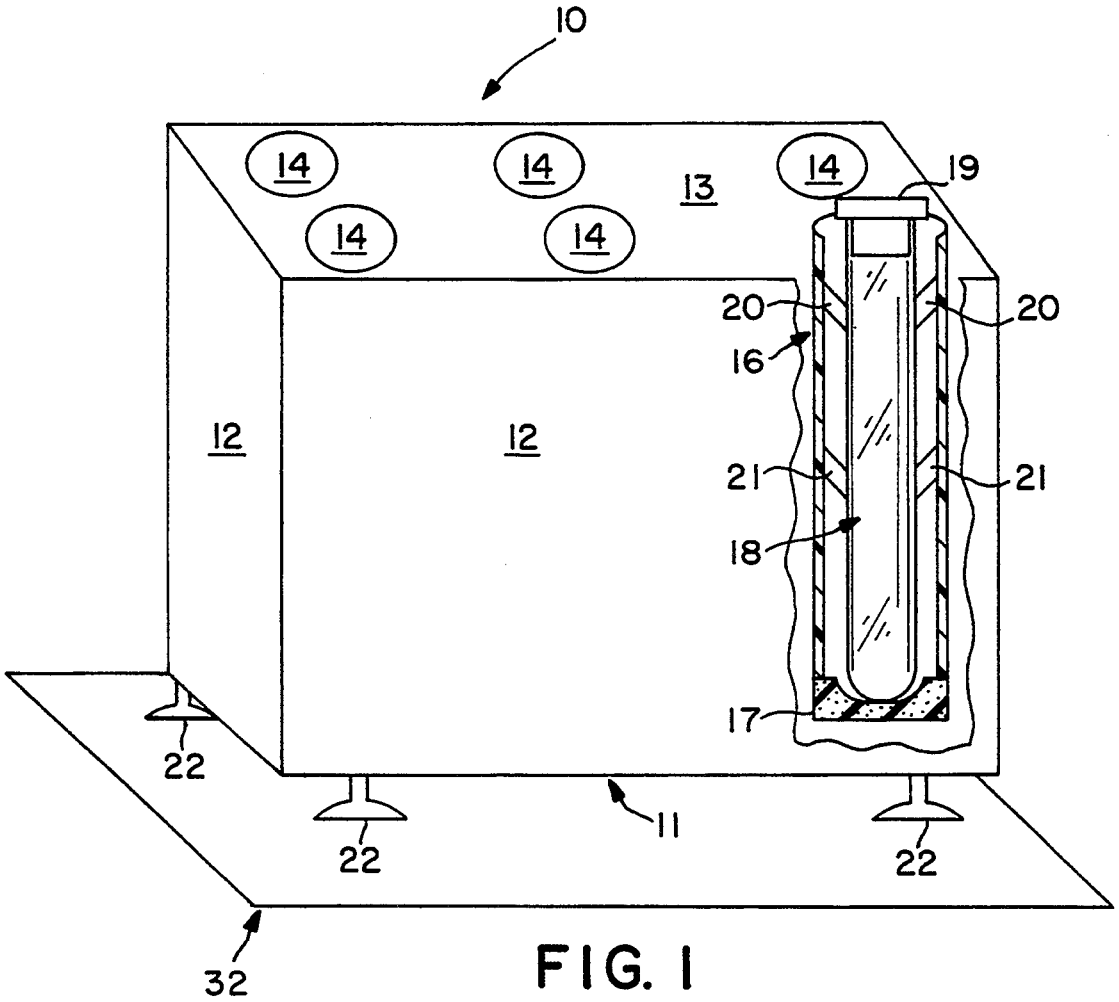
FIG. 1 is a schematic illustration of a blood tube safety box according to the present invention with a partial sectional view of a holder for the test tube.

With reference to FIG. 1 there is shown a blood tube safety box according to one embodiment of the present invention. This structure comprises a housing which is generally indicated by reference numeral 10. Housing 10, which may be formed in a variety of different geometric configurations, is shown in the preferred embodiment as being a substantially rectangular housing having a base 11 with four side walls 12 (two of which are visible in FIG. 1) extending upwardly therefrom and a top portion 13 connected to an upper portion of the side walls 12. The side walls 12 are each connected to form a substantially 90° angle thereby defining the sides of the rectangular housing.

A plurality of openings 14 are formed in the top portion 12. While six openings are shown in the embodiment of FIG. 1, more or less may be used as desired. Additionally, the size of these openings can vary. Preferably, they are at least as large as the size of a test tube (or other type of fluid container) which is to be inserted therein. A generally cylindrical holder 16 extends from each of the openings 14 substantially to the base portion 11 to form a housing 10. One such holder is shown in partial sectional view in FIG. 1. As shown in FIG. 1, a test tube 18 is inserted into the holder 16.

According to one novel aspect of the present invention, there is provided a plurality of projections 20, 21 which are connected at one end to the inner walls of holder 16 and which at the other end, engage the tube 18 having a stopper 19 which is inserted therein. These projections are preferably in groups (e.g., 20, 21) wherein each group comprises two or more portions extending radially inward from the holder 16. As shown in FIG. 1, there are two groups of projections 20, 21 with two projections in each group. Of course, more or less portions may be provided in each group and more than two groups can be provided. The groups may be positioned at various vertical positions within the holder and the portions may be positioned at various radial positions corresponding to these vertical positions. The portions 20, 21 are appropriately sized to engage the tube which is inserted therein.

For example, a number of standard size test tubes are currently available. The portions 20, 21 are preferably sized to extend from the inner wall of holder 16 to contact the outer surface of the smallest test tube that would be used with a particular holder. As slightly larger tubes are used, the portions are deflected downward due to insertion of the tube. For this purpose, it is convenient to make the portions 20 resiliently deformable to thereby provide engagement with the tube by the projections to firmly hold the tube in place. Preferably, the portions 20, 21 are directed at an angle of 25° with respect to vertical axis the holder 16 and the end which contacts the tube 18 can be flat or curved. However, this range can be varied as desired and this angle can be virtually anywhere from 5° to 90°. The portions 20, 21 can be designed to provide a holding force on the test tube which is sufficient to prevent the test tube from being slid out of the holder while a needle is being extracted from the tube during an extraction or insertion process. Also, the number of groups and the number of portions in each group can be selected to further achieve this goal. Preferably, three eguiangularly spaced gripper portions can be provided in each group. In this way different'size test tubes can be held firmly in place. This avoids the need for a user to place his hand on the tube while withdrawing a needle.

Alternatively, or in addition, one or more metal clips may be located at or near the top of the holder 16 to firmly hold the tube in place while enabling the tube to be withdrawn from the holder only when desired.

At the bottom of the holder 16, a foam rubber or other type of cushioning device 17 can be provided to establish a positive stop position for the test tube thereby establishing a vertical position of the tube. Device 17 also cushions the tubes against vibrations or other forces which may occur during transportation of the tubes (in the housing) which could shatter or otherwise damage the tubes.

According to another novel aspect of the present invention, there are provided a plurality of fixation elements 22 which extend downwardly from the outer surface of the base portion 11 of the housing 10. Preferably these elements 22 comprise suction cup-like devices for enabling the box to be removably fixably secured to a table 32 or other support surface. Alternatively, the elements may comprise pads made of non-skid rubber or other suitable materials. As will be apparent to one of ordinary skill in the art, other structures can be used to firmly fix the housing onto a support surface and to prevent it from being slid along the surface. By this combination of features, only one hand is needed to accomplish the fluid transfer process and no contact with the tubes or housing is necessary. In this way, accidental needlesticks can be effectively prevented.

Figure 2:
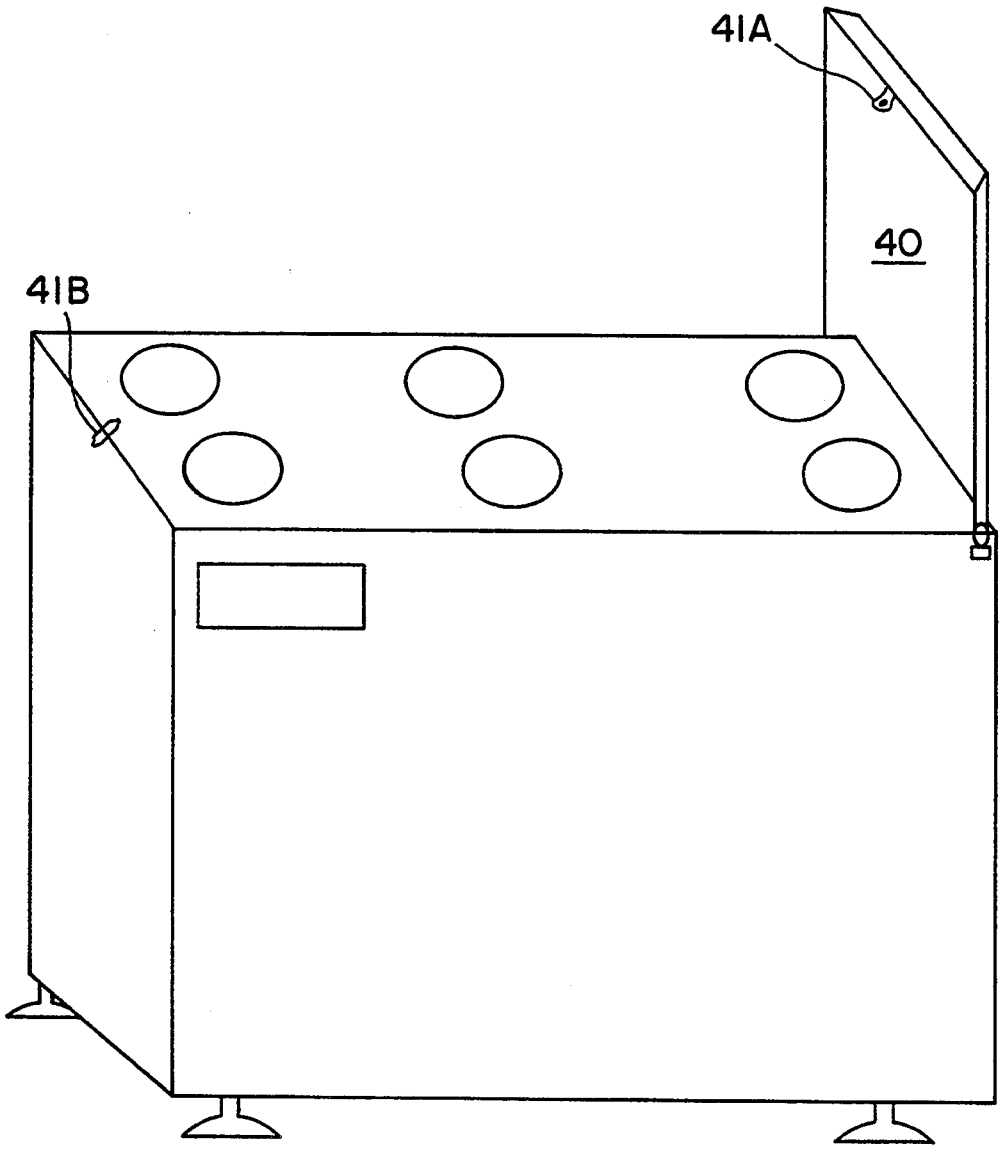
FIG. 2 is a schematic illustration of a blood tube safety box according to FIG. 1 with a cover attached.

According to another embodiment of the present invention as shown in FIG. 2, a cover 40 may be pivotably attached to top portion 13 of the holder 10 or to an upper portion of one or more side walls 12 to enable the housing 10 containing tubes 18 to be covered during transport. This avoids the need for separate packaging and avoids the need to withdraw the tubes from the housing for transport. Moreover, after transport, the tubes still do not need to be withdrawn to perform an analysis of the contents. Rather, since the tubes 18 are firmly secured in the holder 16, a needle, for example, may be inserted into the tube to extract the fluid for sampling. An important aspect of the invention is that it does not require two hand operation when needles are around. Various other types of cover arrangements can also be used as will be readily apparent to one of ordinary skill in the art.

of course, if desired, the tube can be withdrawn for analysis. Preferably, a standard, or specially designed clamp can be used to remove the tube to further avoid the need for the user to contact the tube. Or, this may be done by hand since no needle is used at this time.

According to another embodiment, a security device can be associated with the cover and the housing to secure the contents of the tubes. For example, a lock (41*a*, 41*b*) or other types of security devices may be used where such a feature is desirable or necessary, as shown, for example, in FIG. 2.

Preferably, housing 10 and holder 16 are formed of polypropylene. The fluid container 18 may be a test tube or any other suitable-fluid container. As shown in FIG. 1, the tube is glass, however, the invention is not so limited. If a test tube is used, the tube may contain a rubber stopper 19 to seal the tube. In this case, a needle is inserted through the rubber stopper 19 to either deposit or withdraw fluid to or from the tube in a known manner. As mentioned above, while various preferred embodiments discuss a test tube for holding blood, the invention is not so limited. Various other types of fluid containers may be used and may hold other types of fluids. The cushioning element 17 may be adapted to cause the fluid container 18 to extend a predetermined amount above the top portion 13. Various different sizes of openings and heights for the container may be used based on the type of tubes or fluid containers that are to be used. The portions 20 can be of a plastic or rubber type material or another type of suitable material.

Figure 6:
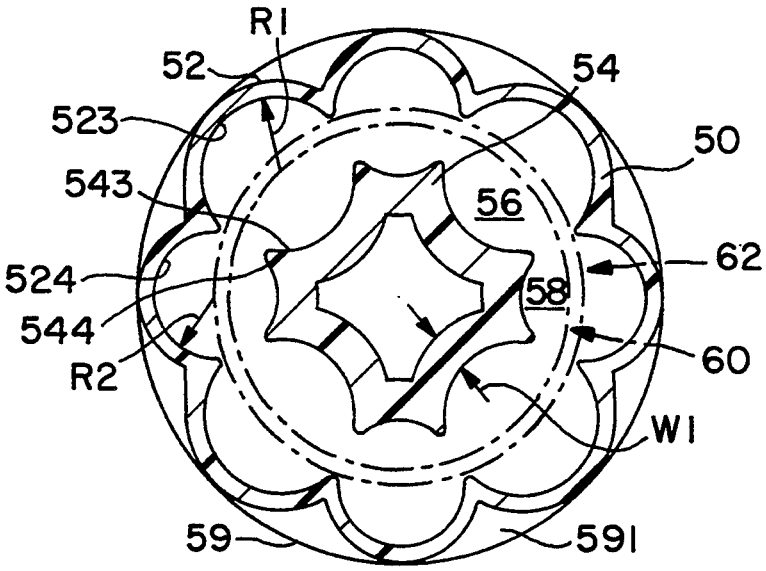
FIG. 6 is a cross section of the blood type safety box taken along section 6—6 of FIG. 5.

FIGS. 3–9 illustrate a blood tube safety box according to a second preferred embodiment. With particular reference to FIGS. 3–6, the blood tube safety box according to the second preferred embodiment comprises a bottom wall 50 with an undulating periphery (FIG. 6), an outer wall 52 extending upwardly from bottom wall 50, and a hollow hub 54 extending upwardly from bottom wall 50 and substantially concentric with outer wall 52. Hub 54 comprises an inner wall of the blood tube safety box. Outer wall 52 includes an inner surface 521 and an outer surface 522. As best seen in FIG. 6, outer wall 52 comprises a plurality of alternating arc shaped portions 523, 524. Arc shaped portions 523 have a first radii of curvature R1 and arc shaped portions 524 have a second radii of curvature R2 which is less than the first radius of curvature R1.

Figure 4:
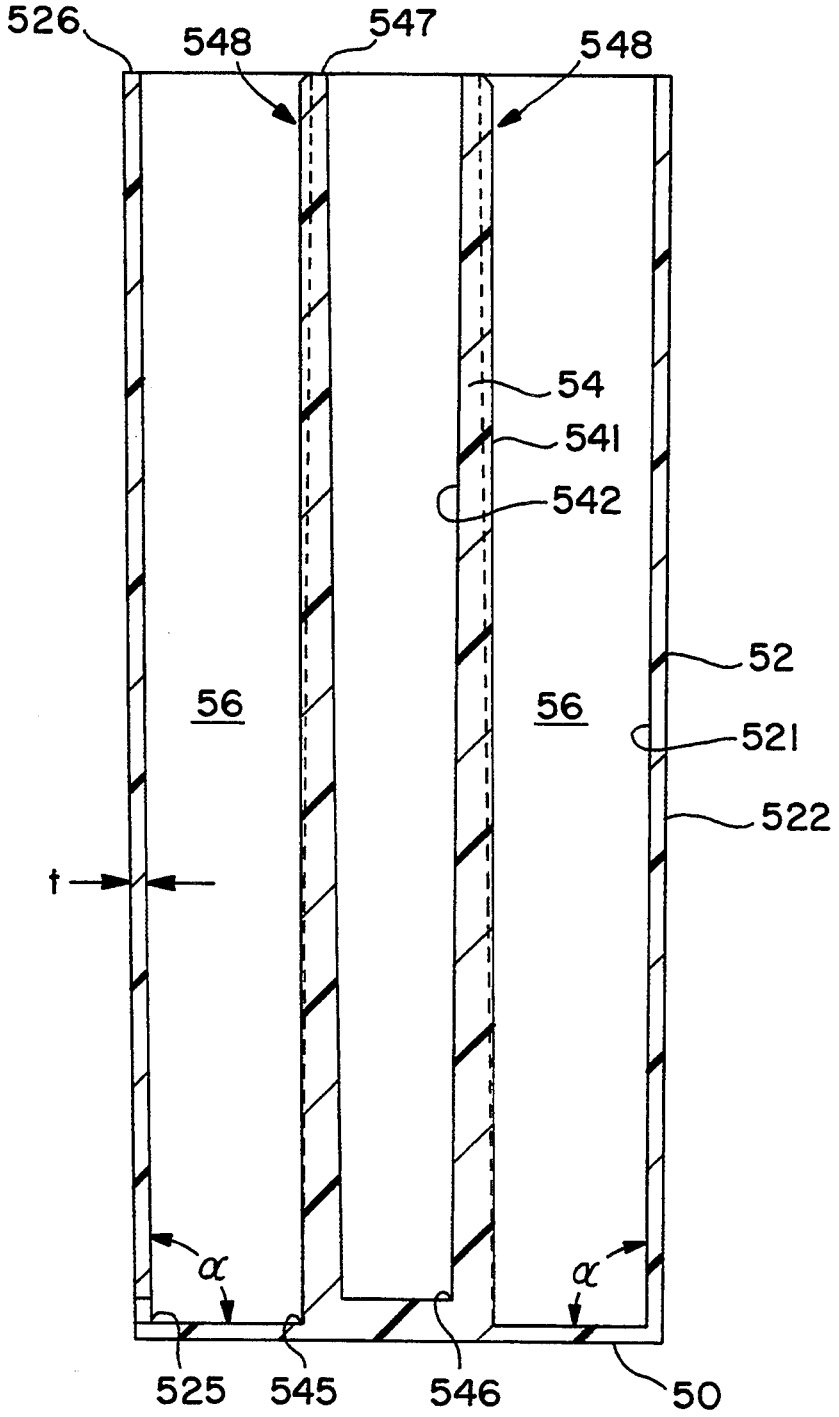
FIG. 4 is a cross section of the blood type safety box taken along section 4—4 of FIG. 3.
Figure 5:
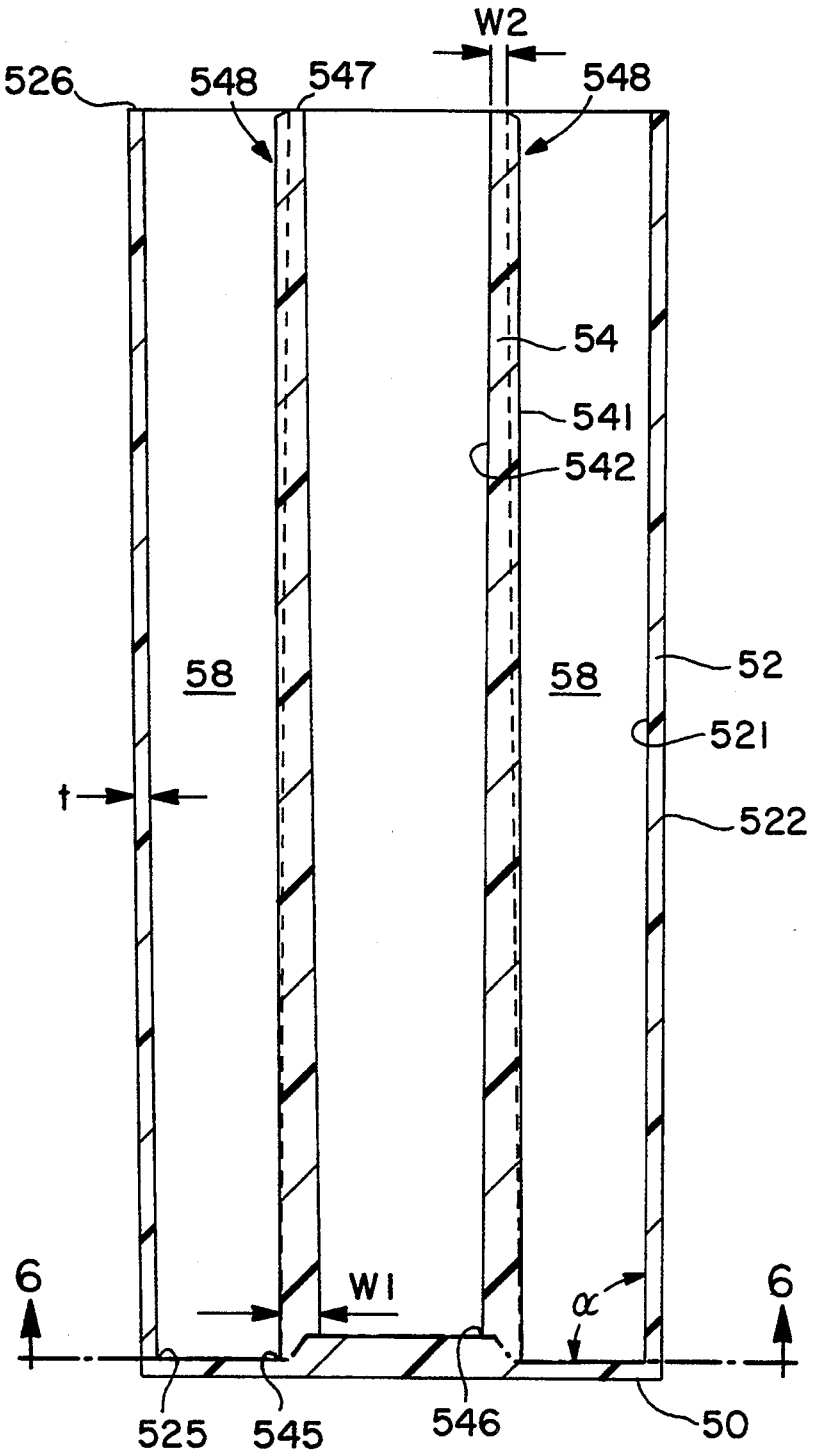
FIG. 5 is a cross section of the blood type safety box taken along section 5—5 of FIG. 3.

As best seen in FIGS. 4 and 5, hub 54 includes an outer surface 541 and an inner surface 542. On its outer surface 541, hub 54 comprises a plurality of alternating arc shaped portions 543, 544 (FIG. 6). Arc shaped portions 543 have a first radii of curvature R1 which is substantially the same as the radii of curvature for arc-shaped portions 523. Arc shaped portions 544 have a second radii of curvature R2 which is substantially the same as the radii of curvature R2 for arc-shaped portions 524. Arc-shaped portions 523, 543 and arc-shaped portions 524, 544 are aligned in a substantially circular arrangement around hub 54 and alternate with one another to define a plurality of alternating circular test tube retaining slots 56, 58 of different sizes. The centers of test tube retaining slots 56 are preferably arranged about a first predetermined locus of points. For example, the centers may be equally spaced around hub 54 on a first circle 60 (FIG. 6). Similarly, the centers of test tube retaining slots 58 are preferably arranged about a second predetermined locus of points. For example, the centers may be equally spaced around hub 54 on a second circle 62 which is concentric and outside of first circle 60.

As best seen in FIG. 4, outer wall 52 has a lowermost point 525 on its inner side 521 where it joins bottom wall 50. Also, at its top, outer wall 52 has a top plane surface 526. Similarly, hub 54 has a lowermost point 545 on its outer side 541 where it joins bottom wall 50 and a lowermost point 546 on its inner side 542 where it joins bottom wall 50. At its top, hub 54 has a top plane surface 547 which is preferably substantially the same height as top plane surface 526.

Outer wall 52 preferably has a constant thickness t. However, the surface of outer wall 52 preferably extends from bottom wall 50 at an angle $\alpha$ slightly greater than 90 degrees. Accordingly, when seen from the top (FIG. 3), both the lowermost point 525 on inner side wall 521 and top plane surface 526 of outer wall 52 can be seen.

Hub 54 is preferably formed with a taper. For example, a base portion of hub 54 which contacts bottom 50 has a first width W1 (FIG. 6). At the top plane surface 547, however, hub 54 has a second width W2 (FIG. 5) which is less than the first width W1. Thus, hub 54 has walls whose thickness decrease in the direction of top plane surface 547. Accordingly, when seen from the top (FIG. 3), the lowermost point 545 on the outer side 541 of hub 54, the lowermost point 546 on the inner side 542 of hub 54, and the top plane surface 547 of hub 54 can all be seen.

Figure 3:
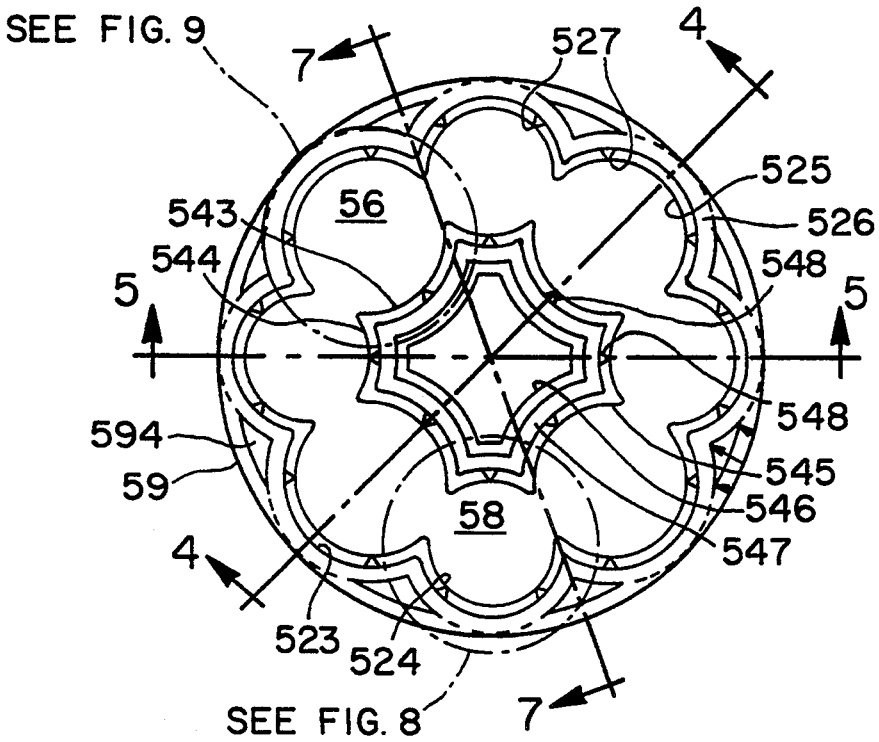
FIG. 3 is a top view of a blood type safety box according to a second preferred embodiment.

With reference to FIGS. 3 and 4, a plurality of ribs 548 are provided on outer surface 541 of hub 54. Ribs 548 preferably extend from top plane surface 547 to bottom wall 50. In the embodiment illustrated, each arc shaped portion 543, 544 has one rib 548 positioned substantially in the middle thereof. However, it is within the scope of the preferred embodiment to provide either more or less than the number of ribs illustrated. Ribs 548 preferably protrude the most nearest top plane surface 547 and taper into outer surface 541 of hub 54 until they substantially blend into outer surface 541 near bottom wall 50. For example, as seen in FIGS. 4 and 5, a cross section of ribs 548 along outer wall 541 of hub 54 reveals that, closest to the top plane surface 547, ribs 548 protrude from outer wall 541 the most. However, ribs 548 gradually taper into outer wall 541 in the direction of bottom wall 50.

Similarly, a plurality of ribs 527 are provided on the inner surface 521 of outer wall 52. None of the cross sections taken in FIG. 3 intersect ribs 527. Nonetheless, it will be understood that, as with ribs 548 on outer wall 541 of hub 54, ribs 527 preferably extend from top plane surface 526 of outer wall 52 to substantially bottom wall 50. More particularly, ribs 527 (FIG. 3), similar to ribs 548, protrude the most from inner surface 521 proximate to top plane surface 526 and gradually taper into inner surface 521 of outer wall 52 until they substantially blend therein near bottom wall 50. In the embodiment illustrated, each arc shaped portion 523, 524 has two ribs 527. However, it is within the scope of the preferred embodiment to provide either more or less than the number of ribs illustrated. Additionally, ribs 527, 548 need not extend the entire length of the slots 56. In either configuration, ribs 527, 548 act as an engaging means to firmly hold a fluid receptacle positioned with tube retaining slots 56, 58.

Figure 7:
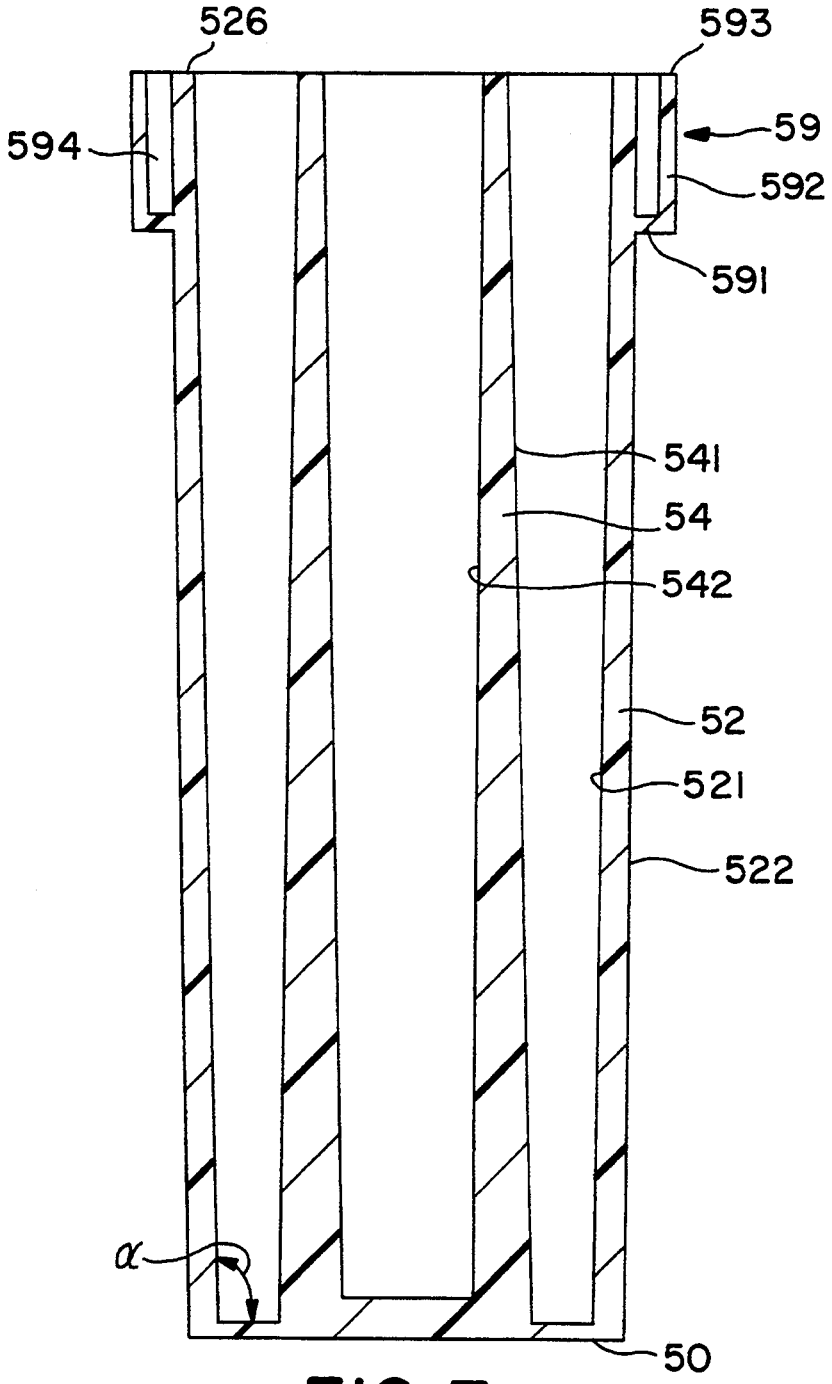
FIG. 7 is a cross section of the blood type safety box taken along section 7—7 of FIG. 3.

With reference to FIG. 7, there is illustrated a cross section of the blood tube safety box taken along section 7—7 of FIG. 3. A lip 59 extends around the outside 522 of outer wall 52 near top plane surface 526. When seen from below (FIG. 6), lip 59 comprises a plurality of curved triangular-like base portions 591 extending from the undulating periphery of outer wall 52. Additionally, lip 59, as seen in FIG. 7, includes a substantially vertical side portion 592 which is substantially parallel to outer wall 52. A top plane surface 593 defines the top of vertical side portion 592. Plane surface 593 is preferably coplanar with plane surfaces 526 and 547. Between outer wall 52 and horizontal side portion 591 and vertical side portion 592 is a void 594.

The interior of each tube retaining slot 56, 58 is slightly conical. In other words, the radii R1, R2 taken adjacent bottom wall 50 is slightly less than the radii R1, R2 taken adjacent top plane surfaces 526, 547. As ribs 527, 548 approach top plane surfaces 526, 547, however, they gradually extend into tube retaining slots 56, 58. Consequently, ribs 527, 548 substantially eliminate the conical shape of tube retaining slots 56, 58. Specifically, ribs 527, 548, together with bottom wall 50, provide substantially the only points contacting the test tubes positioned in the tube retaining slots 56, 58.

With reference to FIG. 6, the foci of radii R1 are preferably arranged along a common circle 60. Similarly, the foci of radii R2 are preferably arranged along a common circle 62 which is concentric with circle 60. Moreover, the circumference of each adjacent test tube retaining slot 56, 58 are preferably substantially tangential. With such a configuration, the blood tube safety box maximizes the number of alternating pediatric and adult size tubes therewithin.

The blood tube safety box is preferably manufactured from molded plastic. A mold is manufactured having substantially the mirror image of the final blood tube safety box. Liquid plastic is poured into the mold, and after it cools and solidifies, the tube safety box is extricated from the mold. The conical configuration for the test tube retaining slots 56, 58 and the tapered configuration for hub 54 facilitate removal of the blood tube safety box from the mold. Additionally, void 594 presents the top portion of the blood tube safety box from shrinking after removed from the mold. Thus, both convenience in manufacturing and snug tolerances are achieved by the preferred blood tube safety box.

Figure 8:
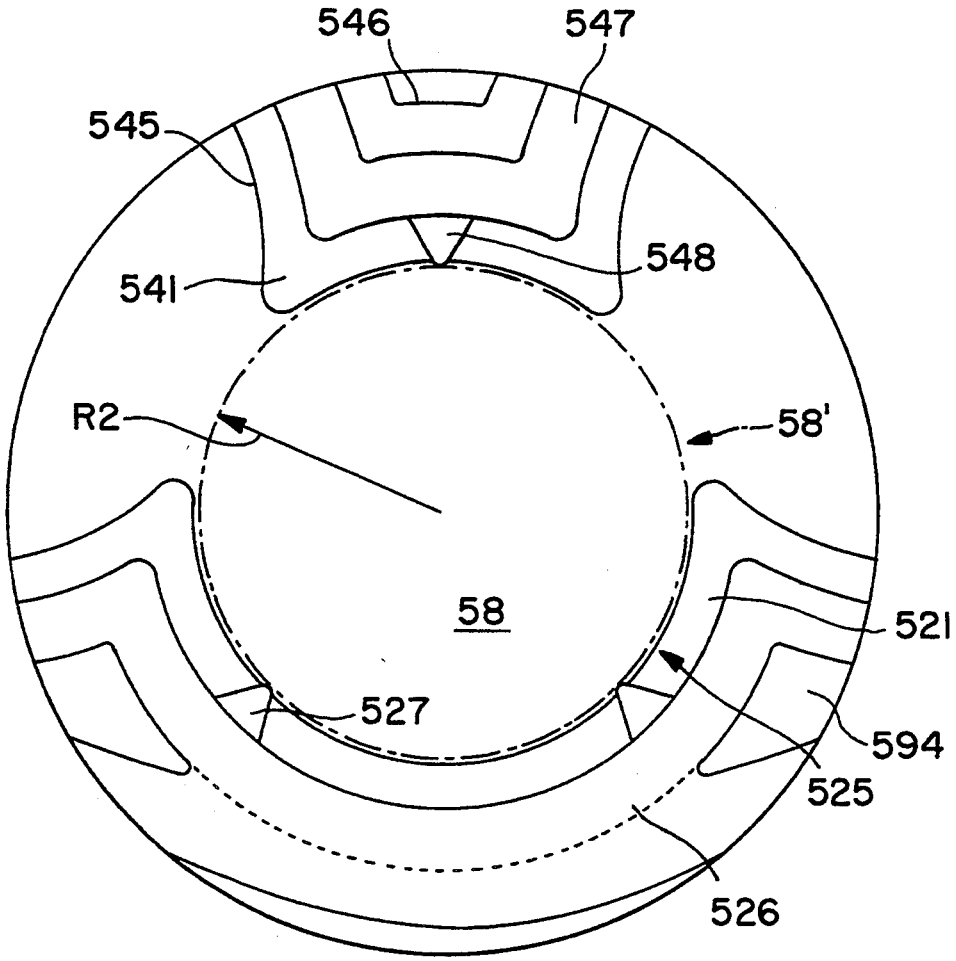
FIG. 8 is an enlarged detail of a portion of the blood type safety box taken from detail 8—8 of FIG. 3.
Figure 9:
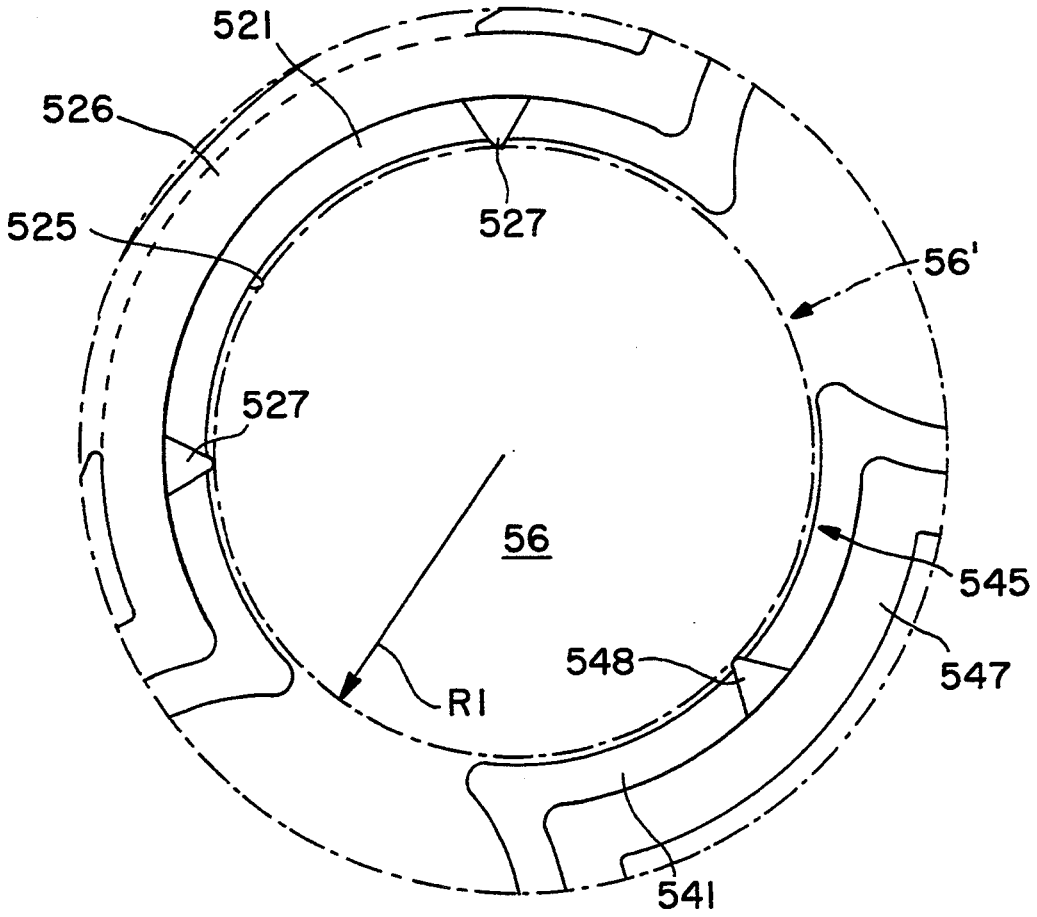
FIG. 9 is an enlarged detail of a portion of the blood type safety box taken from detail 9—9 of FIG. 3.

With particular reference to FIGS. 8 and 9, there is shown in enlarged detail two phantom test tubes 56', 58' contained within respective test tube retaining slots 56, 58. FIG. 9 corresponds to a test tube retaining slot 56 of first radius R1 while FIG. 8 corresponds to a test tube retaining slot 58 of second radius R2. Substantially all of the contact between the test tubes 56', 58' and the blood tube safety box is through ribs 527, 548. Ribs 527, 548, as seen in FIGS. 8 and 9, preferably are equilateral triangular in shape. However, other shapes could be used. As previously discussed, ribs 527, 548 are preferably molded during the molding process for the blood tube safety box. However, it is possible to provide insertable ribs of various slopes and sites. Preferably, ribs 527, 548 eliminate the effect of the taper and provide discreet points of contact with test tubes 56', 58'.

The larger tube retaining slots 56 preferably correspond in size to standard adult size test tubes, while the smaller tube retaining slots 58 preferably correspond in size to standard pediatric size test tubes. However, slots 56, 58 can be manufactured to accommodate test tubes of other sizes. In addition, while the preferred blood tube safety box holds four adult and/or four pediatric sized test tubes in an alternating configuration around hub 54, it will be readily appreciated that the blood tube safety box can readily be designed to accommodate either more or less tests tubes than that disclosed. For example, the blood tube safety box could be designed to accommodate five or more adult and five or more pediatric sized test tubes in alternating order around hub 54. Similarly, the blood tube safety box could be designed to accommodate three adult and three child sized test tubes in alternating order around hub 54.

The blood tube safety box can be molded with identification marks, e.g., numbers or letters, on side wall 522 so that the health care worker can identify and record the test tubes within the respective tube retaining slots 56, 58. In addition, a top, e.g. a plastic or elastic cover or cap (not shown), preferably fits over the top plane surfaces 526, 547, 593, and extends at least partially along vertical wall 592. Alternatively, external threads could be molded on the outside of vertical wall 592 and a threaded plastic cap with internal threads could be provided to engage external threads on vertical wall 592.

FIGS. 10—13 illustrate further preferred embodiments for the blood tube safety box. In each of these alternate embodiments, hub 54 has been modified so that it, or an element extending therefrom, is flexible. With a flexible hub, the required manufacturing tolerances are less than those required when the hub is manufactured substantially inflexible as in the embodiment of FIGS. 3–9.

Figure 10:
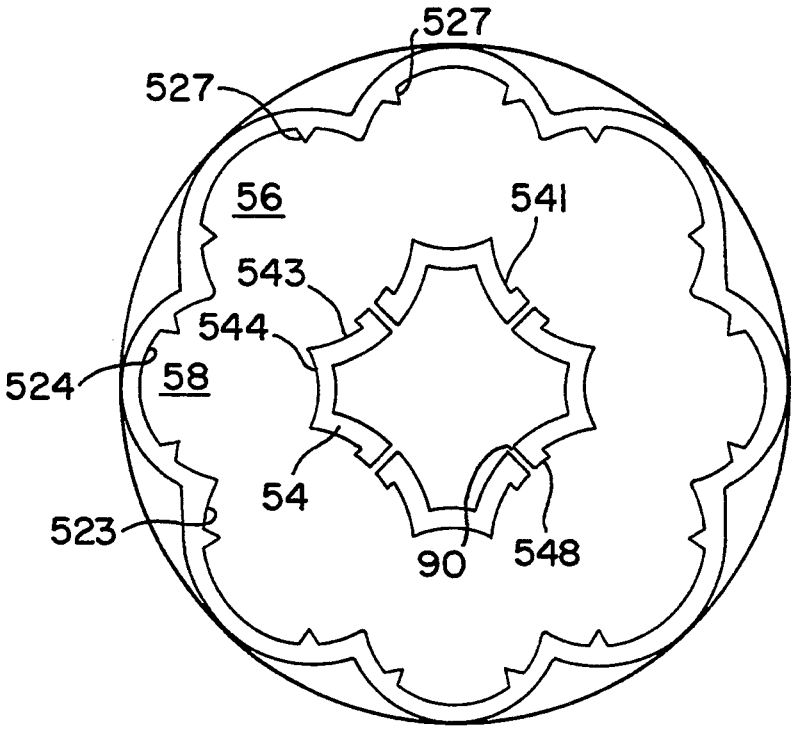
FIGS. 10–13 illustrate blood tube safety boxes having modified hubs.

More particularly, the blood tube safety box of FIG. 10 includes a plurality of alternating test tube retaining slots 56, 58 formed in a generally circular arrangement around hub 54. Hub 54 has an outer surface 541 having a plurality of alternating arc-shaped portions 543, 544 of different diameters. Ribs 548 are formed at the center of arc-shaped portion 543 and have a slot 90 formed therethrough. Slot 90 extends along hub 54 at least partially in the direction of the bottom wall (not labelled in FIG. 10). Slots 90 allow arc shaped portions 543, 544 to flex radially inwardly so that when test tubes are placed in test tube retaining slots 56, 58, a gripping force is applied to the tubes.

Figure 11:
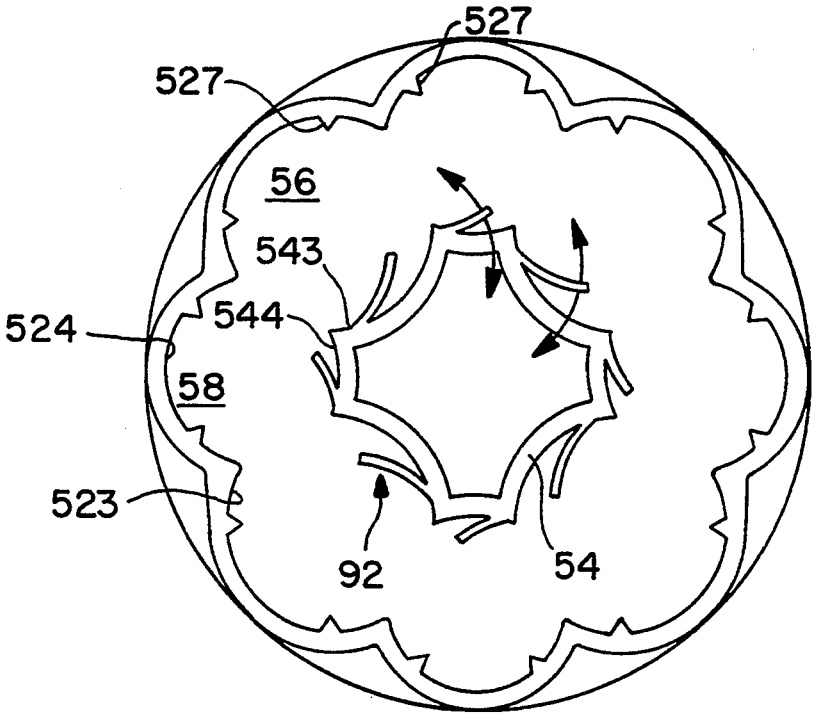

The embodiment of FIG. 11 is similar to that of FIG. 10 except that, instead of slots 90, arcuate arms 92 extend from each of arc-shaped portions 543, 544. When test tubes are placed in test tube retaining slots 56, 58, arms 92 resiliently flex radially inwardly in the direction of the arrows, thereby applying a gripping force to the tubes. Arms 92 extend at least partially in the direction of the bottom wall (not labelled in FIG. 11).

Figure 12:
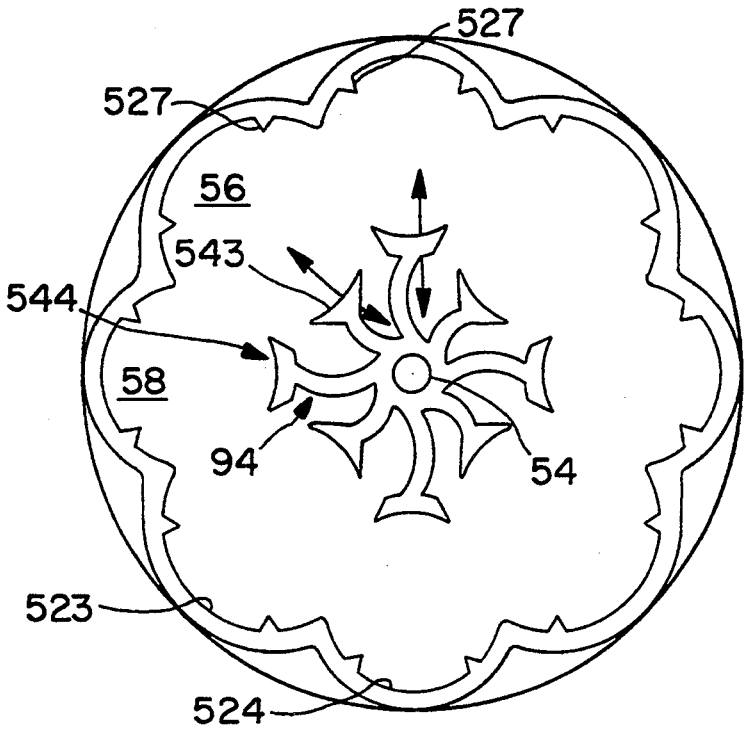

The embodiment of FIG. 12 has a central, substantially circular hub 54 from which a plurality of resilient arms 94 extend. At the end of each resilient arm is a respective arc-shaped portion 543, 544. When test tubes are placed in test tube retaining slots 56, 58, arms 94 resiliently flex radially inwardly in the direction of the arrows, thereby applying a gripping force to the tubes. Arms 94 also extend at least partially in the direction of the bottom wall (not shown in FIG. 12).

Figure 13:
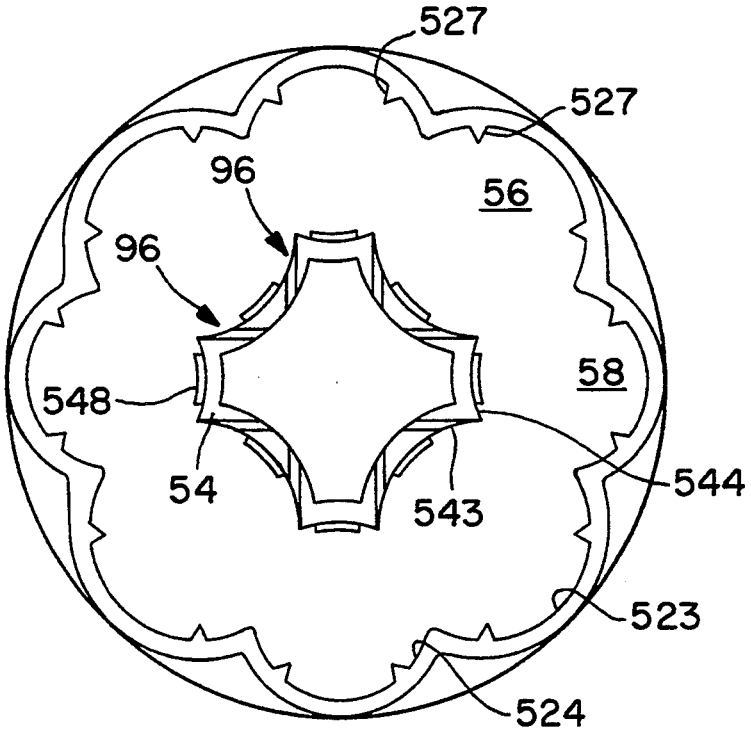

The embodiment of FIG. 13 is similar to the embodiment of FIG. 10 except that, instead of a single slot 90 formed at the center of arc-shaped portion 543, at least two slots 96, 96 are formed on arc-shaped portion 543. When test tubes are placed in test tube retaining slots 56, 58, arc-shaped portions 543, 544 resiliently flex radially inwardly in the direction of the center of the hub 54, thereby applying a gripping force to the tubes.

As with the embodiments shown in FIGS. 1–2, the blood tube safety boxes of FIGS. 3–13 preferably include a plurality of fixation elements which extend downwardly from the outer surface of the bottom wall 50. Preferably, the fixation elements comprise suction cup-like devices for enabling the box to be removably fixably secured to a table or other support surface. However, other fixation devices are contemplated within the scope of the preferred embodiment. For example, a separately securable fixation device to which the blood tube safety box is secured is contemplated.

Figure 14:
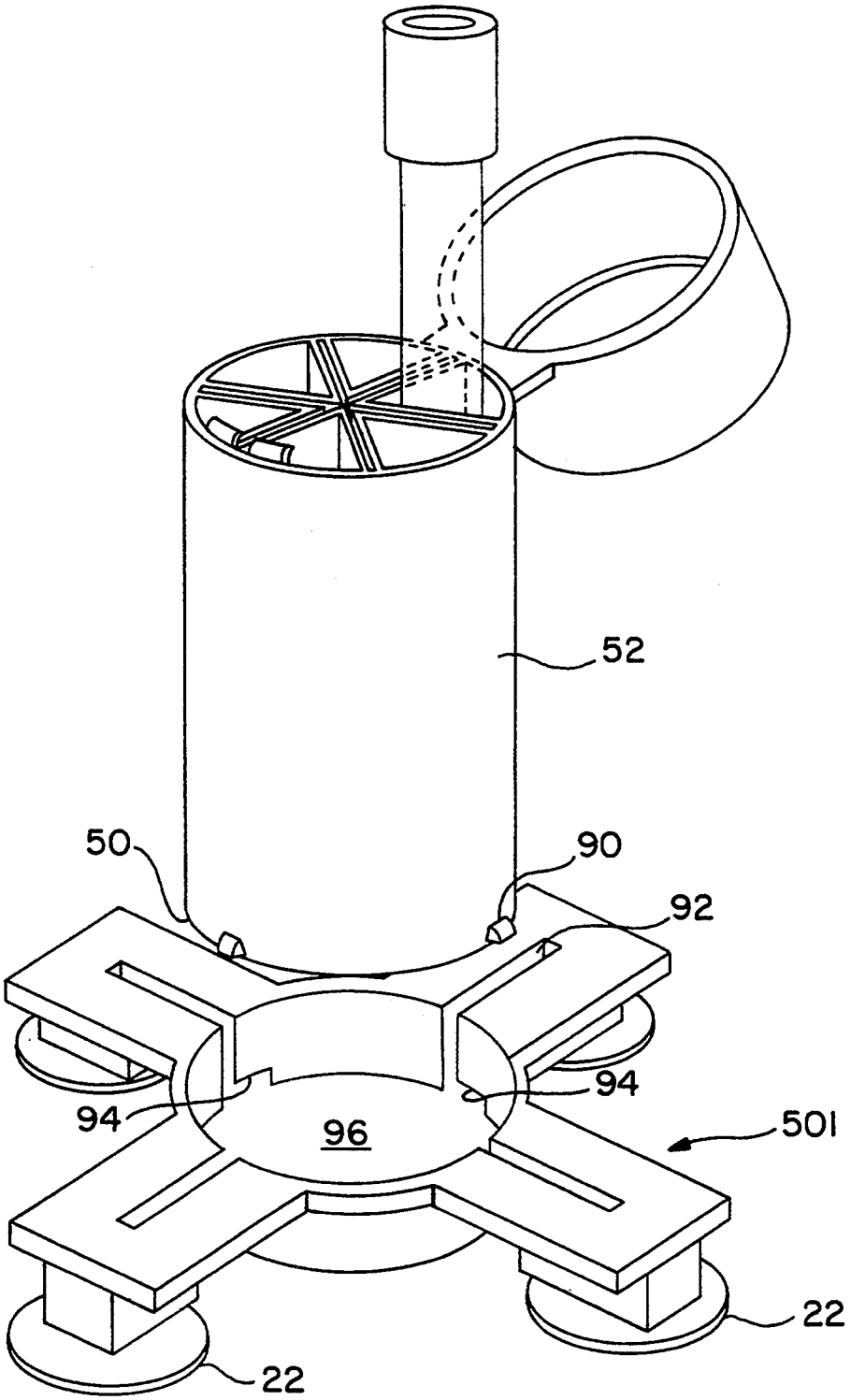
FIG. 14 is a blood tube safety box according to a further embodiment.

One such alternate design is illustrated in FIG. 14 wherein the blood tube safety box could have a plurality of outwardly extending knobs 90 spaced equally around outer wall 52 adjacent bottom wall 50. A separately securable fixation device 501, in addition to having suction cup-like devices 22 for engaging a fiat surface, would have vertical slots 92 equal in number to the outwardly extending knobs 90. In addition, fixation device 501 would have horizontal slots 94 extending from the bottom of vertical slots 92. The blood tube safety box would be positioned in fixation means by inserting each knob 90 into its corresponding vertical slot 92. When the bottom wall 50 contacts the support surface 96 of the separately securable fixation means 501, the blood tube safety box would be rotated so that the knobs 90 are positioned in horizontal slots 94 and away from vertical slots 92. Accordingly, the blood tube safety box would be releasably vertically immobilized within the separately securable fixation means 501. Thus, the health care worker can either add fluid to or remove fluid from the fluid receptacle within the blood tube safety box without handling the fluid receptacle or the blood tube safety box, thereby reducing the possibility of needlestick related injuries and contaminations.

Alternatively, the fixation means comprises a key and groove type fixation system. A separately securable fixation element with suction cups or the like on the bottom thereof would be rerhovably secured to a flat surface. The separately securable fixation element includes either a key or a groove thereon while the lower surface of the bottom wall of the blood tube safety box includes the other of the key or groove not included on the separately securable fixation element. The blood tube safety box is then removably secured to the fixation means by sliding it within the mating key or groove in the separately securable fixation element. Accordingly, the blood tube safety box would be releasably vertically immobilized within the separately securable element.

It is also within the scope of the preferred embodiments to include a fixation means comprising a separately securable fixation element for attachment to a surface such as a counter top or a wall. The separately securable fixation element according to this additional embodiment is preferably configured so that, if secured to a counter top, the fluid receptacle retaining slots in the blood tube safety box are angled with respect to the plane surface of the counter top when the blood tube safety box is removably secured in the separately securable fixation element. Alternatively, the separately securable fixation element according to this additional preferred embodiment is preferably configured so that, if secured to a wall, the fluid receptacle retaining slots are angled with respect to the plane surface of the wall when the blood tube safety box is removably secured in the separately securable fixation element. The angling of the fluid receptacle retaining slots with respect to the wall or counter top is designed to facilitate the addition or withdrawal of fluid from the receptacles. For example, according to this design, the health care worker would not have to vertically align the needle above the fluid receptacle, and could likely easily add or withdrawal fluid while remaining seated.

Figure 15:
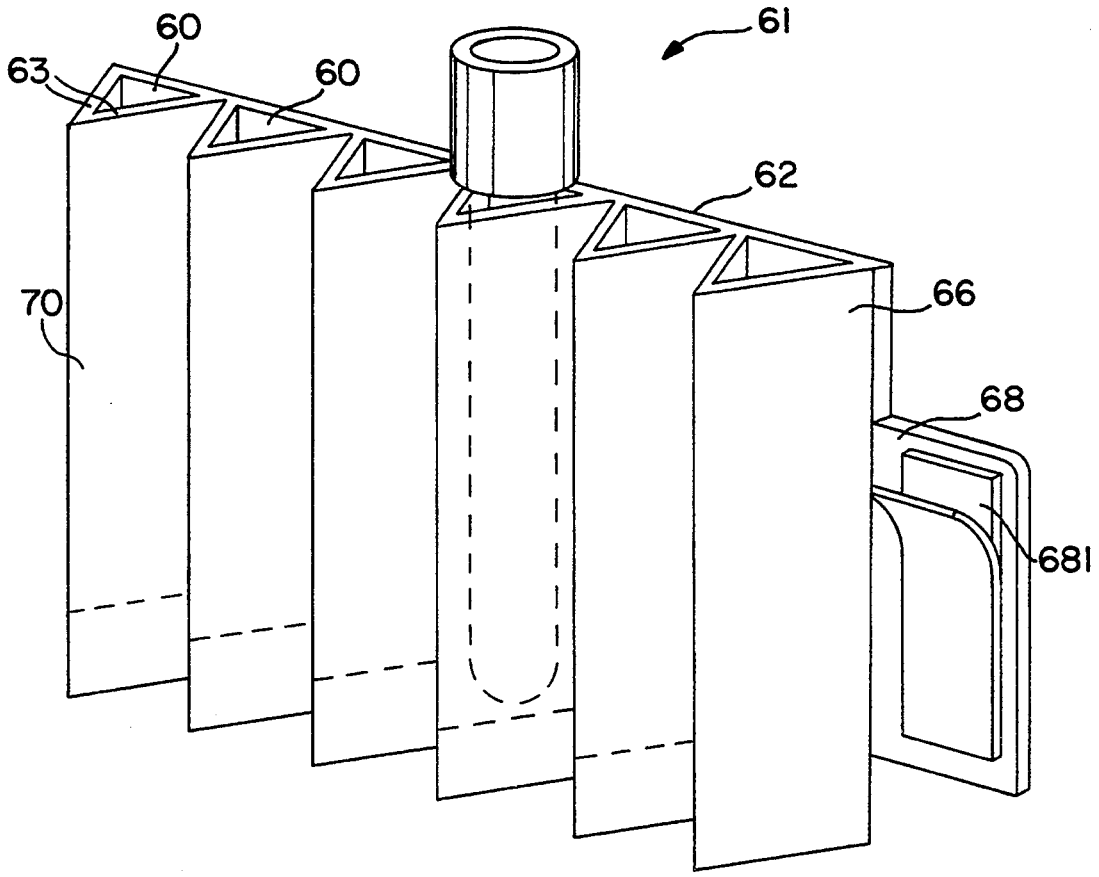
FIG. 15 is a blood tube safety box according to a further embodiment.
Figure 16:
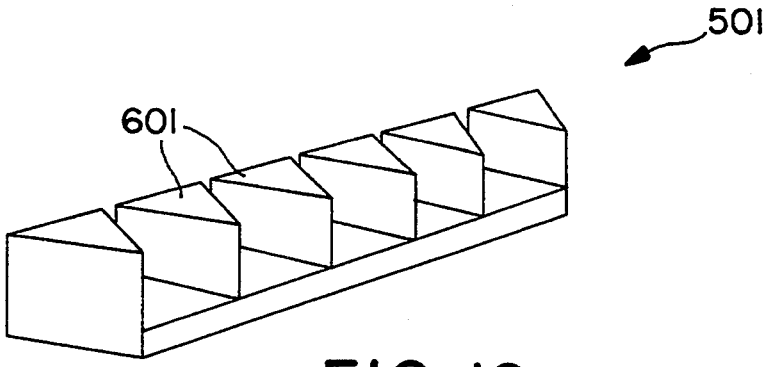
FIG. 16 is a separately securable fixation device for the blood tube safety box of FIG. 15.
Figure 17:
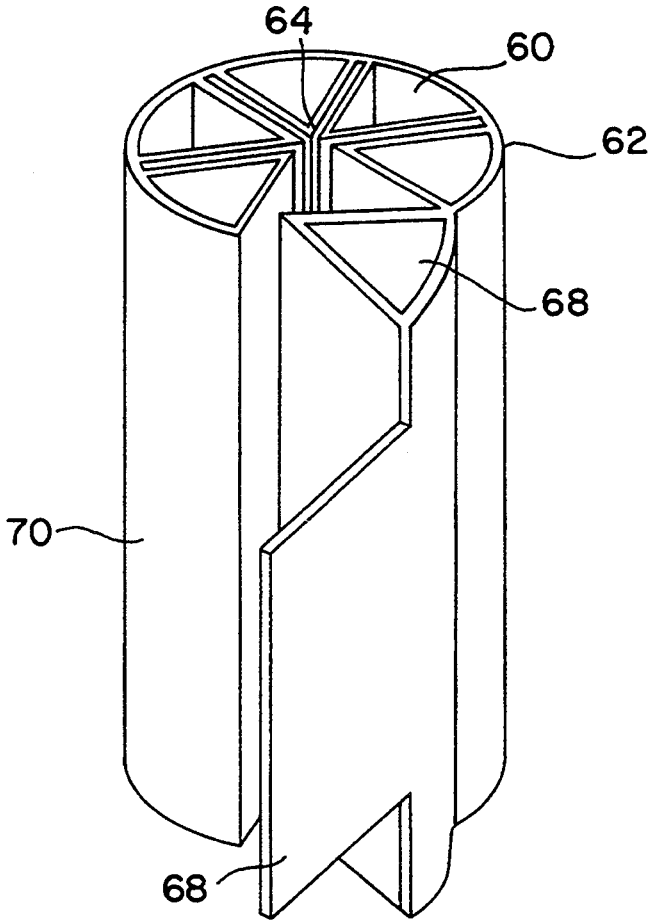
FIG. 17 illustrates the blood tube safety box of FIG. 15 in a folded configuration.

With reference to FIGS. 15–17, a further blood tube safety box 61 comprises a plurality of substantially triangular fluid receptacle slots 60 which are connected to adjacent slots along a common outer wall 62. Each triangular slot 60 is formed by a pair of converging inner walls 63 which extend inwardly from outer wall 62. The inner walls 63 of each slot, however, are not common to the inner walls 63 of adjacent slots 60. Accordingly, the blood tube safety box 61 can be unfolded from a generally circular arrangement of the slots 60 into a generally rectilinear arrangement of the slots 60 (FIG. 5), such that the only connection between adjacent slots 60 is along the common outer wall 62. The outer wall 62, while slightly curved to correspond to the substantially circular outer surface of the folded blood tube safety box (FIG. 17), characterizes one side of one of the fluid receptacle retaining slots. The other sides of the fluid receptacle retaining slot extend inwardly from the outer wall 62 at substantially the same angle so that when the blood tube safety box is folded (FIG. 17), the sides of each slot 60 meet at a centrally located point 64. An end slot 66 has a tab 68 extending from its outer wall 62. A locking device, e.g., an adhesive strip 681, is secured to the tab 68. The tab 68 serves to overlap and fixedly releasably secure an opposite end slot 70 when in the folded configuration. The bottom of each substantially triangular slot 60 is preferably hollow so that corresponding substantially triangular elements 601 protruding from a separately securable fixation means 501 (FIG. 16) can be force fitted into the bottom triangular slots.

More particularly, with reference to FIG. 16, a separately securable fixation device 501 for the foldable blood tube safety box preferably has a plurality of protruding substantially triangular blocks 601 aligned in the same fashion as the substantially triangular slots 60 in the foldable blood tube safety box. The plurality of protruding substantially triangular blocks 601 are preferably aligned side by side in a substantially straight line. Accordingly, when unfolded, the blood tube safety box can be removably secured to the separately securable fixation device 501, and the health care worker can add fluid to or remove fluid from the fluid receptacle without having to manipulate the fluid receptacle or the blood tube safety box, thereby reducing the chances of needlestick injuries and contamination.

The foregoing is a description of the preferred embodiments. Various other alternatives will be readily apparent to one of ordinary skill in the art. The invention is only limited by the claims which are appended hereto.

We claim:

1. A housing for a plurality of fluid receptacles comprising:

a bottom wall;

a first wall extending from said bottom wall and comprising a plurality of alternating curved portions on a surface thereof, said curved portions having a first radius of curvature and at least a second radius of curvature;

a second wall extending from said bottom wall and having a surface opposing said surface of said first wall, said surface of said second wall comprising a plurality of alternating curved portions having said first radius of curvature and said at least said second radius of curvature; wherein said curved portions in said first wall oppose said curved portions in said second wall to form a plurality of fluid receptacle receiving slots having at least a first diameter and a second diameter different from said first diameter.

2. The housing of claim 1, said first wall comprising a substantially circular outer wall depending from said bottom wall, said housing further comprising a hub substantially concentrically disposed within said first wall, and said second wall defining a portion of said hub.

3. The housing of claim 2, said outer wall having undulating outer and inner surfaces.

4. The housing of claim 1, further comprising means, extending from said first and second walls, for engaging the fluid receptacles positioned within said plurality of fluid receptacle receiving slots.

5. The housing of claim 4, said engaging means comprising ribs formed on the surface of said first and second walls.

6. The housing of claim 5, said first wall having at least two ribs formed in each curved portion thereof and said second wall having at least one rib formed in each curved portion thereof.

7. The housing of claim 1, said second wall comprising a hub substantially centrally located internally of said first wall.

8. The housing of claim 7, said fluid receptacle receiving slots of said first diameter arranged around said hub alternately and substantially tangentially with said fluid receptacle receiving slots of said second diameter.

9. A housing for housing a plurality of fluid receptacles wherein said housing is designed to avoid the need for a user to hold the housing or said fluid receptacles during a fluid transfer process, said housing comprising:

a bottom wall;

an outer wall extending from said bottom wall, said outer wall comprising an inner surface facing said inner wall and having a plurality of alternating inner side portions having first and second radii of curvature;

an inner wall substantially centrally located internally of said outer wall;

a plurality of slots formed between said inner wall and said outer wall, wherein said plurality of slots are adapted to receive the fluid receptacles; and engaging means, extending from at least one of said outer and inner walls into said plurality of slots, for engaging a fluid receptacle located therein.

10. The housing of claim 9, further comprising fixation means projecting from said bottom wall for removably fixing said housing on a support surface to prevent undesired horizontal or vertical movement of the housing with respect to said support surface.

11. The housing of claim 9, said engaging means extending from both said inner and outer walls into said plurality of slots.

12. The housing of claim 11, said engaging means comprising a plurality of ribs extending from said inner and outer walls.

13. The housing of claim 9, said engaging means comprising a plurality of ribs extending from said inner and outer walls.

14. The housing of claim 9, said plurality of slots comprising a plurality of circular slots having a first radius and a plurality of circular slots having a second radius.

15. The housing of claim 9, said plurality of slots of said first radius and said plurality of slots of said second radius arranged in alternating order around said inner wall.

16. The housing of claim 14, further comprising four slots having said first radius and four slots having said second radius.

17. The housing of claim 14, said plurality of slots of said first radius arranged around said inner wall with the foci of said first radii arranged around the circumference of a first circle encircling said inner wall.

18. The housing of claim 17, said plurality of slots of said second radius arranged around said inner wall with the foci of said second radii arranged around the circumference of a second circle encircling said inner wall and outside said first circle.

19. The housing of claim 14, said plurality of slots of said first radius substantially tangential with adjacent plurality of slots of said second radius.

20. The housing of claim 9, said inner wall further comprising an outer surface facing said outer wall and having a plurality of alternating outer side portions having said first and second radii of curvature, said alternating outer side portions substantially aligned with corresponding ones of said alternating inner side portions on said outer wall.

21. The housing of claim 9, at least one of said inner and outer walls depending from said bottom wall at an angle greater than 90 degrees.

22. The housing of claim 9, said inner wall comprising a hollow hub, said hollow hub comprising a first wall defining a portion of said plurality of slots, a second wall disposed substantially centrally of said outer wall, and a top plane surface, said first and second walls tapered away from said top plane surface in the direction of said bottom wall.

23. The housing of claim 9, said inner wall extending from said bottom wall.

* * * * *